US007911261B1

(12) United States Patent
Shamarao

(10) Patent No.: US 7,911,261 B1
(45) Date of Patent: Mar. 22, 2011

(54) SUBSTRATE BIAS CIRCUIT AND METHOD FOR INTEGRATED CIRCUIT DEVICE

(75) Inventor: Prashant Shamarao, Duluth, GA (US)

(73) Assignee: Netlogic Microsystems, Inc., Santa Clara, CA (US)

( * ) Notice: Subject to any disclaimer, the term of this patent is extended or adjusted under 35 U.S.C. 154(b) by 0 days.

(21) Appl. No.: 12/386,128

(22) Filed: Apr. 13, 2009

(51) Int. Cl.
*G05F 1/10* (2006.01)

(52) U.S. Cl. ..... 327/535; 327/536

(58) Field of Classification Search ..... 327/534, 327/535, 536, 537
See application file for complete search history.

(56) References Cited

U.S. PATENT DOCUMENTS

| | | | | |
|---|---|---|---|---|
| 4,142,114 | A | 2/1979 | Green | |
| 4,229,667 | A | 10/1980 | Heimbigner et al. | |
| 4,439,692 | A | 3/1984 | Beekmans et al. | |
| 4,585,954 | A | 4/1986 | Hashimoto et al. | |
| 4,628,214 | A | 12/1986 | Leuschner | |
| 4,775,959 | A | 10/1988 | Sato et al. | |
| 4,794,278 | A * | 12/1988 | Vajdic | 327/537 |
| 5,602,506 | A | 2/1997 | Kim et al. | |
| 5,721,510 | A | 2/1998 | Miyajima | |
| 5,818,213 | A | 10/1998 | Kim | |
| 5,818,290 | A * | 10/1998 | Tsukada | 327/537 |
| 6,072,357 | A * | 6/2000 | Jo | 327/536 |
| 6,529,421 | B1 | 3/2003 | Marr et al. | |
| 6,535,435 | B2 * | 3/2003 | Tanaka et al. | 365/189.09 |
| 6,741,118 | B2 * | 5/2004 | Uchikoba et al. | 327/541 |
| 6,914,474 | B2 * | 7/2005 | Yamahira | 327/535 |
| 6,936,998 | B2 * | 8/2005 | Cho | 323/280 |
| 7,012,461 | B1 | 3/2006 | Chen et al. | |
| 7,129,745 | B2 | 10/2006 | Lewis et al. | |
| 7,129,771 | B1 | 10/2006 | Chen | |
| 7,138,851 | B2 | 11/2006 | Sumita et al. | |
| 7,145,318 | B1 * | 12/2006 | Chan et al. | 323/316 |
| 7,151,365 | B2 * | 12/2006 | Nakata | 323/314 |
| 7,330,049 | B2 | 2/2008 | Perisetty | |
| 7,427,890 | B2 * | 9/2008 | Chan | 327/536 |
| 7,479,820 | B2 * | 1/2009 | Okamoto et al. | 327/535 |
| 7,583,131 | B2 * | 9/2009 | Kimura et al. | 327/534 |
| 7,675,348 | B2 * | 3/2010 | Sumita et al. | 327/534 |
| 2007/0132504 | A1 | 6/2007 | Sumita et al. | |
| 2007/0236276 | A1 | 10/2007 | Fujita et al. | |
| 2007/0236277 | A1 | 10/2007 | Naritake | |

* cited by examiner

*Primary Examiner* — Thomas J Hiltunen
(74) *Attorney, Agent, or Firm* — Haverstock & Owens, LLP

(57) ABSTRACT

A substrate biasing circuit may include a first pump control circuit that generates a first control signal in response to a first reference voltage and a voltage of a first substrate portion, and includes a first reference generator coupled between a temperature compensated voltage and a reference power supply voltage that varies the first reference voltage in response to the voltage of the first substrate voltage and the temperature compensated voltage. A first clamp circuit may generate a first clamp signal in response to a first limit voltage and the voltage of the first substrate portion, the first limit voltage being a scaled version of the temperature compensated voltage. A first charge pump may pump the first substrate portion in at least a first voltage direction in response to the first control signal, and is prevented from pumping in the first voltage direction in response to the first clamp signal.

22 Claims, 7 Drawing Sheets

FIG. 14
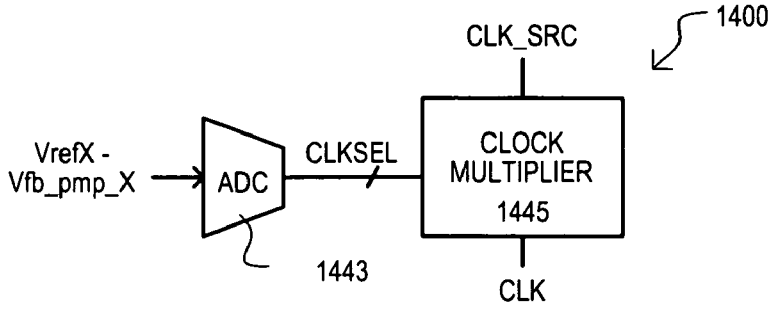
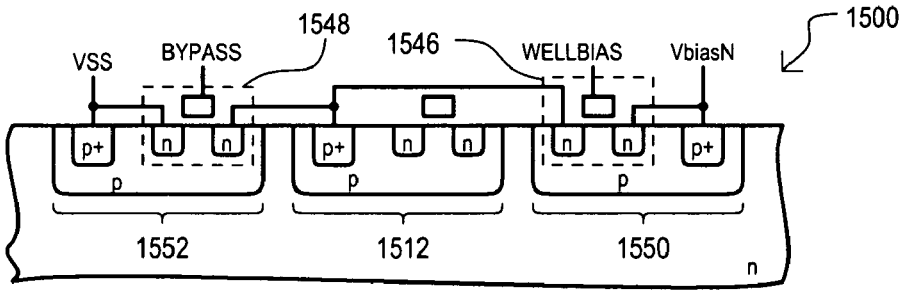
FIG. 15
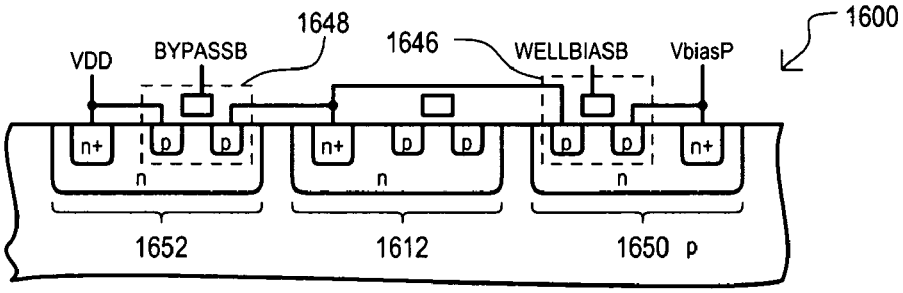
FIG. 16
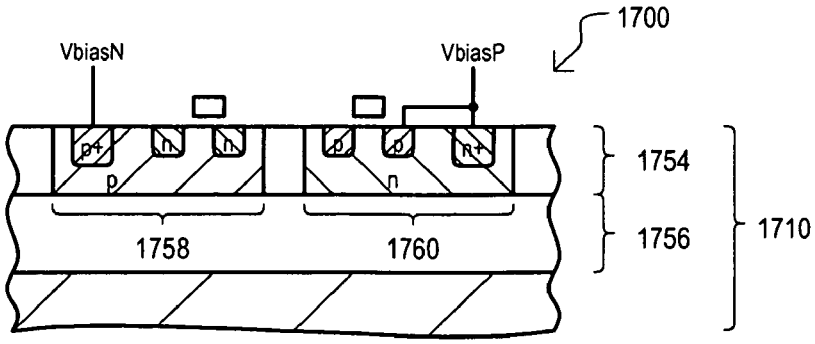
FIG. 17

SUBSTRATE BIAS CIRCUIT AND METHOD FOR INTEGRATED CIRCUIT DEVICE

TECHNICAL FIELD

The present disclosure relates generally to integrated circuits, and more particularly to circuits and methods for biasing substrates of integrated circuit devices.

BACKGROUND

Integrated circuits (ICs) are typically formed by doping different regions of a semiconductor substrate with n-type and/or p-type conductivity impurities. Complementary metal-oxide-semiconductor (CMOS) ICs may include n-channel MOS field effect transistors (MOSFETs) formed in p-type regions of a substrate as well as p-channel MOSFETs formed in n-type regions of the same substrate. In one example of a single well CMOS process, n-type wells (n-wells) may be formed in a p-type substrate. N-channel MOSFETs may be formed in the p-type regions, and p-channel MOSFETs may be formed in the n-wells. In many applications, n-wells are biased to a high power supply (e.g., VCC or VDD), while p-wells are biased to a low power supply reference (e.g., VSS or ground).

In some memory devices, such as dynamic random access memories (DRAMs), a substrate may be p-type, with n-wells formed therein. In addition, one or more array p-wells may be formed within n-wells. Such array p-wells may contain DRAM memory cells. While the p-type substrate may be biased to ground, the memory cell p-well may be biased to a negative voltage (sometimes called a back bias voltage, or VBB). A back bias voltage can reduce leakage from n-channel MOSFETs within such memory cells.

BRIEF DESCRIPTION OF THE DRAWINGS

FIG. 14 shows one example of a pump clock control circuit that may be included in embodiments.

FIG. 15 shows one example of a bypass arrangement that may be included in embodiments.

FIG. 16 shows another example of a bypass arrangement that may be included in embodiments.

FIG. 17 shows a substrate biasing arrangement according to a further embodiment.

DETAILED DESCRIPTION

Figure 1:
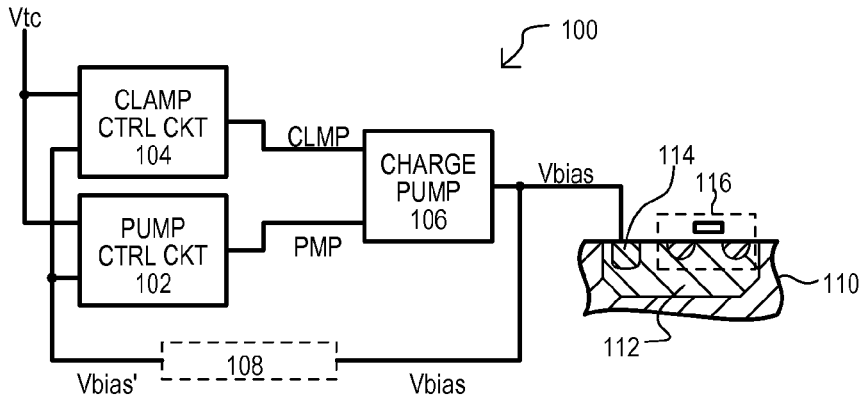
FIG. 1 is a block schematic diagram of a substrate bias circuit according to one embodiment.

Various embodiments will now be described in detail that show circuits, integrated circuit devices, and systems for controlling a bias voltage of one or more portions of an integrated circuit substrate. Control of charge pump functions and pumping limits may be based on a temperature compensated reference voltage, and thus not vary in response to changes in a power supply voltage. Further, charge pump functions may be controlled based on transistor performance, rather than some absolute current leakage value. Consequently, integrated circuit embodiments may include transistor device performance ranges that are tighter than that achieved by process parameters only.

In the following descriptions, like sections are referred to with the same reference character but with a first digit corresponding to the figure number.

Referring now to FIG. 1, a substrate bias circuit according to a first embodiment is shown in block schematic diagram, and designated by the general reference character 100. A substrate bias circuit 100 may include a pump control circuit 102, a clamp control circuit 104, a charge pump 106, and a feedback path 108. A substrate bias circuit 100 may bias a portion of an integrated circuit substrate portion 110 to a bias potential (Vbias).

A pump control circuit 102 may receive temperature compensated voltage (Vtc) and a feedback bias voltage (Vbias') from substrate portion 110, and generate a control signal (PMP). A temperature compensated voltage (Vtc) may be a voltage that remains substantially constant over a wide temperature range. In one embodiment, a Vtc may be generated by counteracting positive temperature coefficient circuit elements (e.g., circuit elements that result in a voltage that drifts higher as temperature increases) with negative temperature coefficient circuit elements (e.g., circuit elements that result in a voltage that drifts lower as temperature increases). In one very particular embodiment, a Vtc may be "bandgap" reference voltage, in which a negative temperature coefficient of a pn junction's forward voltage (VBE in a biased npn bipolar transistor) is compensated for with the thermal voltage $V_T$ (well understood to be kT/q). A feedback bias (Vbias') may be the same as, or derived from bias potential (Vbias) generated by charge pump 106.

A pump control circuit 102 may utilize Vtc and Vbias' to generate a control feedback value reflecting actual transistor performance. It is noted that because a pump control circuit 102 utilizes Vtc, such an approach may determine a transistor performance value independent of an applied power supply voltage. In one particular arrangement, a control feedback value based on Vbias' may be compared to a temperature compensated reference value. According to such a comparison, a control signal PMP may be activated or deactivated.

A clamp control circuit 104 may receive temperature compensated voltage (Vtc) and a feedback bias voltage (Vbias') and generate clamp signal CLMP. In a particular embodiment, clamp control circuit 104 may utilize Vtc to generate a limit value that is compared to Vbias'. Because a clamp control circuit 102 utilizes Vtc to generate a limit value, such a limit may also remain independent of an applied power supply voltage. In one particular arrangement, a feedback bias voltage Vbias' may be compared to a limit value. According to such a comparison, a clamp signal CLMP may be activated or deactivated. In this way, a clamp control circuit 104 may establish a limit to feedback bias voltage Vbias'. When such a limit is exceeded, clamp signal CLMP may be activated, thus preventing a biased portion of substrate 110 from exceeding some predetermined limit.

A charge pump 106 may receive control signal PMP and clamp signal CLMP, and response, generate bias potential Vbias. In one embodiment, a charge pump 106 may be bidirectional with respect to signal PMP. That is, when control signal PMP has a first value, charge pump 106 may pump in a first voltage direction (e.g., over time it drives Vbias more negative). Conversely, when control signal PMP has a second value, charge pump 106 may pump in a second voltage direction, opposite to the first voltage direction. In another embodiment, a charge pump 106 may be unidirectional. When control signal PMP has a first value, it pumps in a first voltage direction, and when signal PMP has a second value, it stops pumping, enabling leakage or other effects to force bias potential Vbias in the opposite direction to the pumped direction.

A charge pump 106 may also be active or passive with respect to clamp signal CLMP. In the active case, in response to clamp signal CLMP being activated, a charge pump 106 may pump in a predetermined direction away from a corresponding limit value. For example, if a limit value corresponds to a maximum negative voltage limit, a charge pump 106 may pump in the positive voltage direction. Conversely, if a limit value corresponds to a maximum positive voltage limit, a charge pump 106 may pump in the negative voltage direction. In a passive design, in response to clamp signal CLMP being activated, a charge pump 106 may deactivated, enabling leakage or other effects to force bias potential Vbias in a direction opposite to that corresponding to the limit value.

Bias potential (Vbias) may be fed back to pump control circuit 102 and clamp control circuit 104 by feedback path 108. A feedback path 108 may be a conductive connection so that a feedback bias voltage Vbias' is essentially the same as bias potential Vbias. However, as will be described in other embodiments, a feedback path 108 may include circuits, such as filters or the like, to remove transient features of bias potential Vbias and/or ensure stability of the substrate bias circuit 100 over a predetermined operating range.

Referring still to FIG. 1, a substrate 110 may include a well 112, a well tap 114, and an insulated gate field effect transistor 116 (hereinafter MOSFET, though not implying any particular type of gate insulator material). A substrate portion 110 may be of a first conductivity type (e.g., n-type or p-type), while a well may be of a second conductivity type (e.g., p-type or n-type). A substrate portion 110 may be a bulk portion of a substrate, or may itself be a well formed in some larger substrate region. Charge pump 106 may apply bias potential (Vbias) to well 112 via well tap 114. Well tap 114 may be doped to the same conductivity type as well 112, but at a higher concentration. Transistor 116 may be an enhancement mode MOSFET. According to bias potential (Vbias), a performance of transistor 116 may be modulated.

It is understood that all or a portion of substrate bias circuit 100 may be formed in a same integrated circuit substrate as substrate portion 110.

In this way, a substrate bias circuit may bias a substrate region by operation of a charge pump, where the charge pump is controlled based on transistor performance and temperature compensated voltage, as opposed to an absolute leakage value and/or a reference voltage that may vary according to power supply level.

Figure 2:
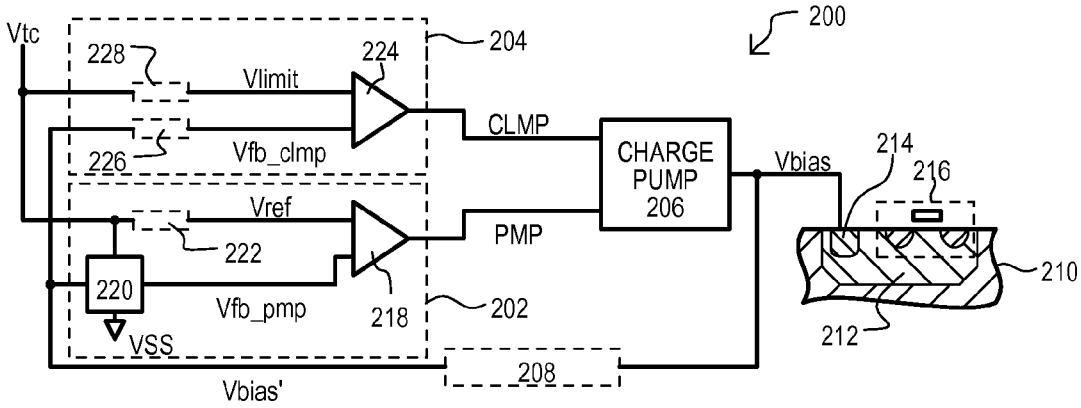
FIG. 2 is a block schematic diagram of a substrate bias circuit according to another embodiment.

Referring now to FIG. 2, a substrate bias circuit according to another embodiment is shown in a block schematic diagram and designated by the general reference character 200. In very particular arrangements, the embodiment of FIG. 2 may be one version of that shown in FIG. 1.

In the embodiment of FIG. 2, a pump control circuit 202 may include a control amplifier 218, a reference generator 220, and optionally, a reference scalar circuit 222. A control amplifier 218 may have a first input connected to receive a feedback control voltage (Vfb_pmp) from a reference generator 220, a second input connected to receive a temperature compensated reference voltage Vref, and an output that provides a control signal PMP to charge pump 206.

A reference generator 220 may be biased between a temperature compensated voltage (Vtc), and a power supply reference voltage VSS, which in this embodiment may be ground. In addition, a reference generator 220 may receive feedback bias voltage Vbias', which may correspond to bias potential Vbias output from charge pump 206. Reference generator 220 may output voltage Vfb_pmp, which can vary according to bias potential Vbias'. Optionally, reference scalar circuit 222 may scale voltage Vtc to generate reference voltage Vref.

Based on a comparison between feedback control voltage Vfb_pmp and reference voltage Vref, control amplifier 218 may drive control signal PMP high or low, to thereby control charge pump 206 as described above in conjunction with FIG. 1.

Referring still to FIG. 2, a clamp control circuit 204 may include a clamp amplifier 224, and optionally, a feedback scalar circuit 226 and/or a clamp scalar circuit 228. A clamp amplifier 224 may have a first input connected to receive a feedback clamp voltage (Vfb_clmp) and a second input connected to receive a temperature compensated limit voltage (Vlimit), and an output that provides a clamp signal CLMP to charge pump 206.

Optionally, feedback scalar circuit 226 may scale a feedback bias voltage (Vbias') to generate feedback clamp voltage (Vfb_clmp). In addition, optionally, clamp scalar circuit 228 may scale temperature compensated voltage Vtc to generate limit voltage (Vlimit).

In this way, a substrate bias circuit may control a charge pump according to a comparison between a temperature compensated reference voltage, and feedback voltage generated by a feedback circuit biased between a temperature compensated voltage and power supply reference voltage. The feedback voltage may vary in response to changes in the charge pump output voltage.

Figure 3:
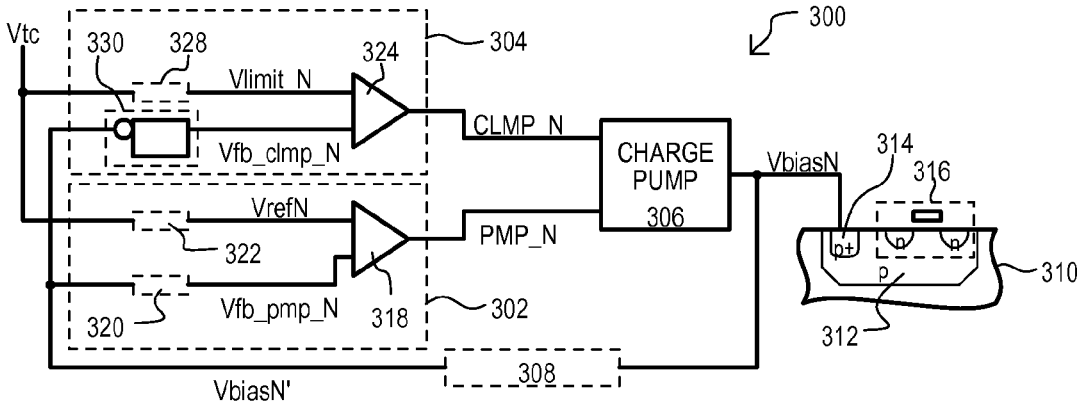
FIG. 3 is a block schematic diagram of a substrate bias circuit according to a further embodiment.

Referring now to FIG. 3, a substrate bias circuit according to a further embodiment is shown in a block schematic diagram and designated by the general reference character 300. In very particular arrangements, the embodiment of FIG. 3 may be one version of that shown in FIG. 1 or 2.

In the embodiment of FIG. 3, a charge pump 306 drives a p-well 312 formed in a n-type substrate region 310 with a bias potential VbiasN. Further, it is assumed that VbiasN can be driven to, or is maintained at, a negative potential.

A pump control circuit 302 may include a control amplifier 318, and optionally a reference scalar circuit 322 and a reference generator circuit 320. A control amplifier 318 may have a first input connected to receive a feedback control voltage (Vfb_pmp_N) from a reference generator 320, a second input connected to receive a temperature compensated reference voltage VrefN, and an output that provides a control signal PMP_N to charge pump 306. A reference generator 320 may be configured like that shown as 220 in FIG. 2, or alternatively, may be a voltage scaling circuit that scales feedback bias voltage VbiasN' to generate voltage (Vfb_pmp_N). Based on a comparison between feedback control voltage Vfb_pmp_N and reference voltage VrefN, control amplifier 318 may drive control signal PMP high or low, to thereby control charge pump 306.

Referring still to FIG. 3, a clamp control circuit 304 may include a clamp amplifier 324, a polarity inverting circuit 330, and optionally, a clamp scalar circuit 328. A clamp amplifier 324 may have a first input connected to receive a feedback clamp voltage (Vfb_clmp_N) and a second input connected to receive a temperature compensated limit voltage (Vlimit_N), and an output that provides a clamp signal CLMP_N to charge pump 306. A polarity inverting circuit 330 may invert, and optionally scale, a negative feedback bias voltage VbiasN, to generate a positive feedback clamp voltage (Vfb_clmp_N). Optional clamp scalar circuit 328 may scale temperature compensated voltage Vtc to generate limit voltage (Vlimit_N).

In response to control signal PMP_N being activated (indicating that bias potential VbiasN is too high), charge pump 306 can pump p-well in a negative voltage direction. In response to control signal PMP_N being deactivated (indicating that bias potential VbiasN is acceptably low), charge pump 306 may cease pumping, enabling p-well to rise on potential due to leakage, or may begin pumping in a positive voltage direction.

In a similar fashion, in response to clamp signal CLMP_N being activated (indicating that bias potential VbiasN is too low), regardless of the value of control signal PMP, charge pump 306 may cease pumping, enabling p-well to rise on potential due to leakage, or may begin pumping in a positive voltage direction.

In this way, a substrate bias circuit may include a polarity inversion circuit for changing the polarity of a substrate bias voltage prior to comparison with a temperature compensated limit voltage.

Figure 4:
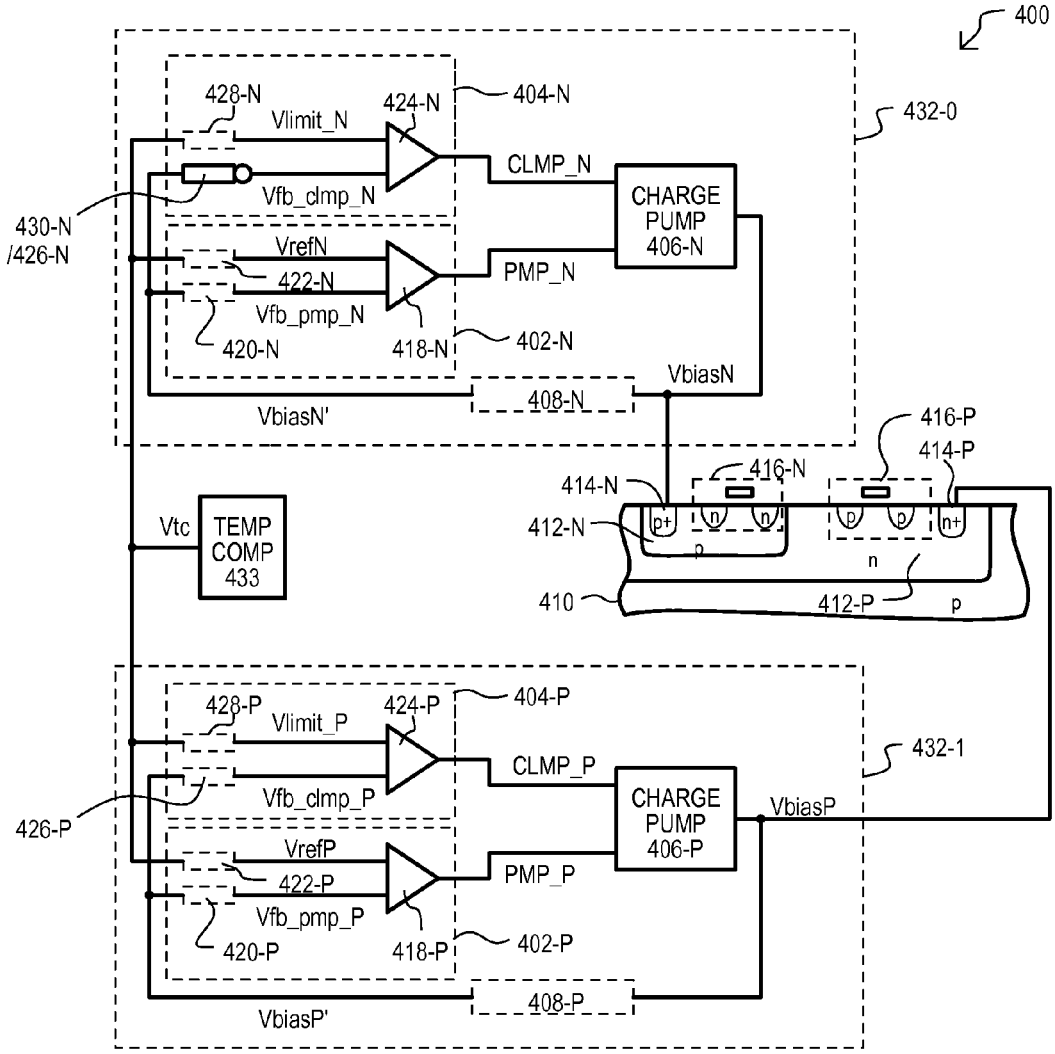
FIG. 4 is a block schematic diagram of a substrate bias circuit according to another embodiment.

Referring now to FIG. 4, a substrate bias circuit according to still another embodiment is shown in a block schematic diagram and designated by the general reference character 400. In very particular arrangements, the embodiment of FIG. 4 may be one version of that shown in FIG. 1, 2 or 3.

In the embodiment of FIG. 4, substrate bias circuit 400 includes two pumping sections 432-0 and 432-1. Pumping section 432-0 may provide a bias potential VbiasN to a p-type well 412-N. A section 432-0 may take the form of any of the embodiments shown in FIG. 1, 2 or 3. Accordingly, a pump control circuit 402-N may optionally include a reference generator 420-N and/or reference scalar circuit 422-N. Similarly, a clamp control circuit 404-N may optionally include a feedback scalar circuit 426-N and/or a clamp scalar circuit 428-N, which may include a polarity inverting circuit 430.

In one embodiment, in response to control signal PMP_N being activated, charge pump 406-N may pump p-type well 412-N in a negative voltage direction. In response to controls signal PMP_N being inactive, charge pump 406-N may be disabled, or alternatively, may pump p-type well 412-N in a positive voltage direction. In response to clamp signal CLMP_N being activated, charge pump 406-N may be disabled, or alternatively, may pump p-type well 412-N in a positive voltage direction.

Referring still to FIG. 4, pumping section 432-1 may provide a bias potential VbiasP to an n-type well 412-P. A pumping section 432-1 may take the form of any of the embodiments shown in FIG. 1 or 2. Accordingly, a pump control circuit 402-P may optionally include a reference generator 420-P and/or reference scalar circuit 422-P. Similarly, a clamp control circuit 404-P may optionally include a feedback scalar circuit 426-P and/or a clamp scalar circuit 428-P.

In one embodiment, in response to control signal PMP_P being activated, charge pump 406-P may pump n-type well 412-P in a positive voltage direction. In response to controls signal PMP_P being inactive, charge pump 406-P may be disabled, or alternatively, may pump n-type well 412-P in a negative voltage direction. In response to clamp signal CLMP_P being activated, charge pump 406-P may be disabled, or alternatively, may pump n-type well 412-P in a negative voltage direction.

In the particular embodiment shown, p-well 412-N may be formed in an n-well 412-P. However, other embodiments may include differing well structures and arrangements.

FIG. 4 also shows a temperature compensation voltage circuit 433. Temperature compensation voltage circuit 433 may generate a temperature compensated voltage Vtc that is provided to pumping sections 432-0 and 432-1. Temperature compensation voltage circuit 433 may include at least first voltage generating portion having a positive temperature coefficient that is counteracted by a second voltage generation portion having a negative temperature coefficient.

In one embodiment, all portions of substrate bias circuit 400 may be formed in a same integrated circuit substrate.

In this way, a substrate bias circuit may include multiple pumping sections, for driving substrate regions of different conductivity types.

Figure 5:
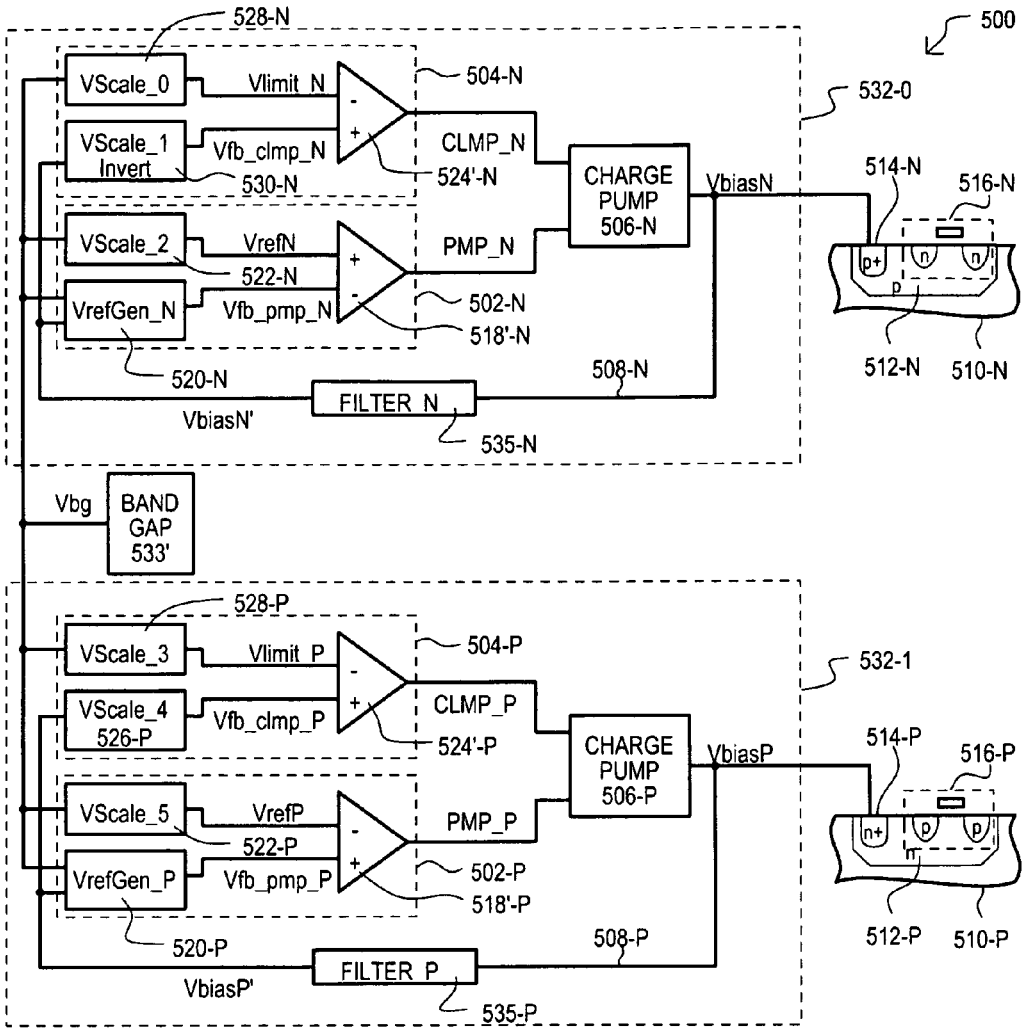
FIG. 5 is a block schematic diagram of a substrate bias circuit according to still another embodiment.

Referring now to FIG. 5, a substrate bias circuit according to a further embodiment is shown in a block schematic diagram and designated by the general reference character 500. In very particular arrangements, the embodiment of FIG. 5 may be one version of those shown in any of FIGS. 1-4.

As in the case of FIG. 4, in the embodiment of FIG. 5, a substrate bias circuit 500 includes a pumping sections 532-0 that provides a bias potential VbiasN to a p-type well and pumping section 532-1 that provides a bias potential VbiasP to an n-type well.

In the embodiment of FIG. 5, a temperature compensated voltage may be a "band gap" reference voltage Vbg. Further, a substrate bias circuit 500 may include band gap reference circuit 533' for generating voltage Vbg.

Referring still to FIG. 5, in the embodiment shown, within pumping section 532-0, a pump control circuit 502-N may include a control operational amplifier (op amp) 518'-N having a (+) input connected to a reference scalar circuit 522-N, a (−) input connected to a reference generator 520-N, and an output that provides a first control signal PMP_N. Reference scalar circuit 522-N may scale voltage Vbg by a scaling factor Vscale_2, which may be a suitable real number value, to generate reference voltage VrefN. Reference generator 520-N may receive voltage Vbg and feedback bias voltage (VbiasN'), and in response, generate a feedback control voltage Vfb_pmp_N. Voltage Vfb_pmp_N may represent a performance of n-channel MOSFETs having a body bias of VbiasN'. In such an arrangement, while feedback control voltage (Vfb_pmp_N) is less than reference voltage VrefN, a charge pump 506-N may drive VbiasN (and hence VbiasN') to a more negative voltage. When feedback control voltage (Vfb_pmp_N) exceeds reference voltage VrefN, charge pump 506-N may stop, or begin pumping in the opposite direction.

A clamp control circuit 504-N may include a clamp op amp 524'-N having a (−) input connected to a clamp scalar circuit 528-N, a (+) input connected to a polarity inversion and scaling circuit 530-N, and an output that provides a first clamp signal CLMP_N. Clamp scalar circuit 528-N may scale voltage Vbg by a scaling factor Vscale_0, which may be a suitable real number value. Polarity inversion and scaling circuit 530-N may invert a feedback voltage VbiasN', and scale such a voltage by a scaling factor Vscale_1, which may be a suitable real number value. In such an arrangement, while feedback clamp voltage (Vfb_clmp_N) is less than limit voltage Vlimit_N, a charge pump 506-N may respond to control signal PMP_N generated by pump control circuit 504-N. However, when feedback clamp voltage (Vfb_clmp_N) exceeds limit voltage Vlimit_N, regardless of a control signal value PMP_N, charge pump 506-N may stop, or alternatively, start pumping in the positive voltage direction.

Pumping section 532-0 may also include a filter 535-N. A filter 535-N may filter bias potential VbiasN to generate feedback bias voltage Vbias'. As but one example, a filter may be a low pass filter tuned to reduce transients arising from charge pump operations.

Referring yet again to FIG. 5, in the embodiment shown, within pumping section 532-1, a pump control circuit 502-P may include a control op amp 518'-P having a (−) input connected to a reference scalar circuit 522-P, a (+) input connected to a reference generator 520-P, and an output that provides a second control signal PMP_P. Reference scalar circuit 522-P may scale voltage Vbg by a scaling factor Vscale_5, which may be a suitable real number value, to generate reference voltage VrefP. Reference generator 520-P may receive voltage Vbg and feedback bias voltage (VbiasP'), and in response, generate a feedback control voltage Vfb_pmp_P. Voltage Vfb_pmp_P may represent a performance of p-channel MOSFETs having a body bias of VbiasP'. In such an arrangement, while feedback control voltage (Vfb_pmp_P) is greater than reference voltage VrefP, a charge pump 506-P may drive VbiasP to a more positive voltage. When feedback control voltage (Vfb_pmp_P) falls below a reference voltage VrefP, charge pump 506-P may stop, or begin pumping in the opposite direction.

A clamp control circuit 504-P may include a clamp op amp 524'-P having a (−) input connected to a clamp scalar circuit 528-P, a (+) input connected to a feedback scalar circuit 526-P, and an output that provides a second clamp signal CLMP_P. Reference clamp scalar circuit 528-P may scale voltage Vbg by a scaling factor Vscale_3, which may be a suitable real number value. Feedback scalar circuit 526-P may scale a feedback voltage VbiasP' by a scaling factor Vscale_4, which may also be a suitable real number value. In such an arrangement, while feedback clamp voltage (Vfb_clmp_P) is less than limit voltage Vlimit_P, clamp signal CLMP_P may be inactive, and charge pump 506-P may respond to control signal PMP_P generated by pump control circuit 504-P. However, when feedback clamp voltage (Vfb_clmp_P) exceeds limit voltage Vlimit_P, clamp signal CLMP_P may be activated, and regardless of a control signal PMP_P, charge pump 506-P may stop, or alternatively, start pumping in the negative voltage direction.

Like pumping section 532-0, pumping section 532-1 may include a filter 535-P. A filter 535-P may filter bias potential VbiasP to generate feedback bias voltage VbiasP'. As but one example, a filter may be a low pass filter tuned to reduce transients arising from charge pump operations.

In this way, a substrate bias circuit may scale a band gap reference voltage to provide control limits and clamping limits for charge pump circuits that control both n-type and p-type regions of an integrated circuit device. Further, feedback voltages from the substrate regions may be filtered.

Figure 6:
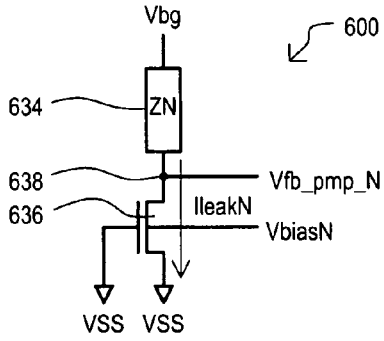
FIG. 6 shows on example of a reference generator that may be included in embodiments.

Referring now to FIG. 6, one example of a reference generator according to an embodiment is shown in a schematic diagram and designated by the general reference character 600. In very particular arrangements, reference generator 600 may be one example of that shown as 220 in FIG. 2, 320 in FIG. 3, 420-N in FIG. 4 or 520-N in FIG. 5.

A reference generator 600 may generate feedback control voltage (Vfb_pmp_N) reflecting leakage characteristics of an n-channel MOSFET (NMOS device). Such a leakage characteristic may be based on a temperature compensated biasing of the NMOS device, and hence not substantially vary in response to changes in a power supply voltage.

In the very particular example of FIG. 6, reference generator 600 may include a first reference impedance 634 and a reference NMOS device 636. First reference impedance 634 may be connected between a temperature compensated voltage (in this very particular embodiment, a band gap voltage Vbg) and a first reference output node 638. Reference NMOS 636 may have a source-drain path connected between first reference output node 638 and a power supply reference VSS (e.g., ground). Reference NMOS device 636 may have a body that receives feedback bias voltage VbiasN that may correspond to a biasing of p-wells in an integrated circuit device. For example, such a voltage may be the actual voltage applied to the wells, or such a voltage after being filtered. In the particular example of FIG. 6, a gate of reference NMOS device 636 may also be connected to VSS.

In such a configuration, a leakage current IleakN may be drawn by NMOS device 636 creating a voltage drop across first reference impedance 634 to generate feedback control voltage Vfb_pmp_N. Further, as a feedback bias voltage VbiasN is driven in a negative voltage direction, due to the body effect on NMOS device 636, leakage current IleakN will grow smaller. This, in turn, will cause feedback control voltage Vfb_pmp_N to increase. Conversely, as a feedback bias voltage VbiasN is driven more positive, leakage current IleakN will increase, causing feedback control voltage Vfb_pmp_N to grow smaller.

It is noted that in other embodiments, a gate of reference NMOS may receive a temperature compensated biasing voltage. For example, to achieve a lower range for IleakN, a gate of reference NMOS may receive a negative temperature compensated voltage. Conversely, to achieve a higher range for IleakN, a gate of reference NMOS may receive a slightly positive (but less than a p-n forward bias voltage) temperature compensated voltage.

Still further, reference generator 600 may be biased between two temperature compensated voltages (e.g., between Vbg and a scaled version of Vbg, or between two differently scaled versions of Vbg).

In still other embodiments, a reference impedance 634 may be a temperature compensated reference impedance. That is, such an impedance may include differing materials with counteracting temperature coefficients, or active circuit elements (e.g., transistors) configured to counteract the temperature coefficient of a "bulk" portion of a reference impedance.

Figure 7:
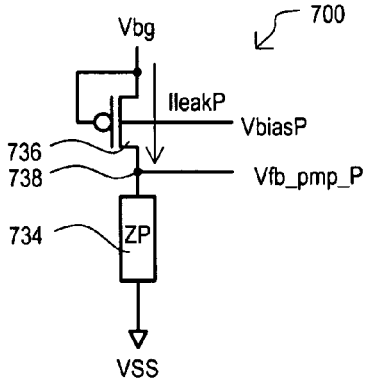
FIG. 7 shows another example of a reference generator that may be included in embodiments.

Referring now to FIG. 7, another example of a reference generator according to an embodiment is shown in a schematic diagram and designated by the general reference character 700. In very particular arrangements, reference generator 700 may be one example of that shown as 220 in FIG. 2, 420-P in FIG. 4 or 520-P in FIG. 5.

A reference generator 700 may generate feedback control voltage (Vfb_pmp_P) reflecting leakage characteristics of a p-channel MOSFET (PMOS device). As in the case of FIG. 6, such a leakage characteristic may be based on a temperature compensated biasing of the PMOS device, and hence not significantly vary in response to changes in a power supply voltage.

In the very particular example of FIG. 7, a reference PMOS device 736 may have a source-drain path connected between a temperature compensated voltage (in this very particular embodiment, a band gap voltage Vbg) and a second reference output node 738. A second reference impedance 734 may be connected between second reference output node 738 and a power supply reference VSS (e.g., ground). Like FIG. 6, reference PMOS device 736 may have a body that receives feedback bias voltage VbiasP that may correspond to a biasing of n-wells in an integrated circuit device, and may be a filtered version of such a voltage. In the particular example of FIG. 7, a gate of reference PMOS device 736 may also be connected to Vbg.

In such a configuration, as a feedback bias voltage VbiasP is driven in a positive voltage direction, due to the body effect on reference PMOS 736, a leakage current IleakP flowing through reference PMOS device will grow smaller, causing feedback control voltage Vfb_pmp_P to decrease. Conversely, as a feedback bias voltage VbiasP is driven more negative, leakage current IleakP will increase, causing feedback control voltage Vfb_pmp_P to rise.

Like the embodiment of FIG. 6, a gate of reference PMOS may receive a temperature compensated biasing voltage and/or reference generator 700 may be biased between two temperature compensated voltages. Further, reference impedance 734 may be a temperature compensated impedance.

In this way, reference generators may generate a voltage corresponding to a leakage current drawn by an n-channel device or p-channel device biased with temperature compensated voltages.

Figure 8:
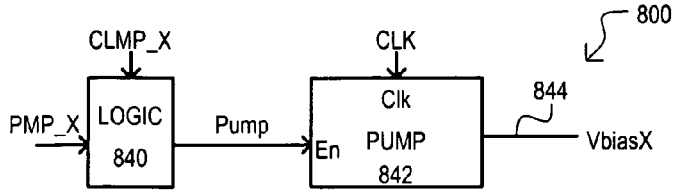
FIG. 8 shows on example of a charge pump that may be included in embodiments.

Referring now to FIG. 8, one example of a charge pump according to one embodiment is shown in a block schematic diagram and designated by the general reference character 800. In very particular arrangements, charge pump 800 may be one example of that shown as 106 in FIG. 1, 206 in FIG. 2, 306 in FIG. 3, 406-(N or P) in FIG. 4 or 506-(N or P) in FIG. 5. Charge pump 800 may be a unidirectional charge pump that drives a bias potential VbiasX in one voltage direction.

Charge pump 800 may include control logic 840 and a pump circuit 842. Control logic 840 may receive a control signal PMP_X and a clamp signal CLMP_X and output a pump activation signal Pump. Control logic 840 may drive signal Pump to an active or inactive level in response to control signal PMP_X being active or inactive, respectively. Further, in response to clamp signal CLMP_X being active, control logic 840 may drive signal Pump to an inactive regardless of control signal PMP_X.

When activated according to signal Pump, a pump circuit 842 may drive a bias potential VbiasX in one voltage direction (e.g., negative or positive) based on clock signal CLK. As but one example, a pump circuit 842 may include one or more stages, with each stage including a pump capacitor configured to pump on half cycles. In a first half cycle, a first capacitor terminal may be connected to a first power supply node (e.g., VDD or VSS) while a second capacitor terminal is connected to a second power supply node (VSS or VDD). In a subsequent half cycle, the first capacitor terminal may be connected to the second power supply node (VSS or VDD) while the second capacitor terminal may be connected to pump output 844 to drive bias potential VbiasX in a predetermined voltage direction.

When de-activated according to signal Pump, a pump circuit 842 may present a high impedance at pump output 844.

Figure 9:
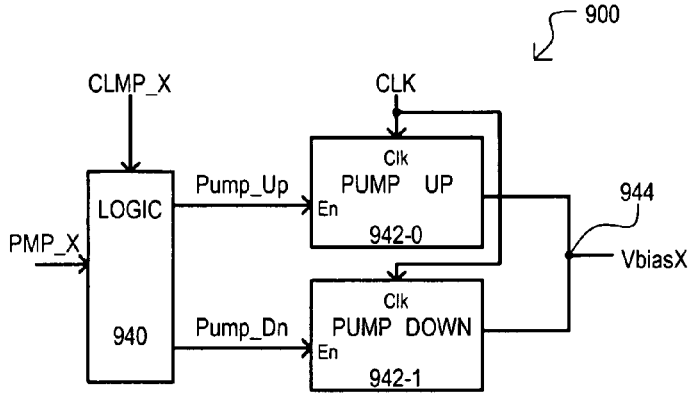
FIG. 9 shows another example of a charge pump that may be included in embodiments.

Referring now to FIG. 9, another example of a charge pump according to one embodiment is shown in a block schematic diagram and designated by the general reference character 900. In very particular arrangements, charge pump 900 may be one example of that shown as 106 in FIG. 1, 206 in FIG. 2, 306 in FIG. 3, 406-(N or P) in FIG. 4 or 506-(N or P) in FIG. 5. Charge pump 900 may be a bidirectional charge pump that drives a bias potential VbiasX in either a positive or negative voltage direction.

Charge pump 900 may include control logic 940, a pump up circuit 942-0, and a pump down circuit 942-1. Control logic 940 may receive a control signal PMP_X and a clamp signal CLMP_X and output a pump up activation signal Pump_Up and a pump down activation signal Pump_Dn. Control logic 940 may drive signal Pump_Up to an active or inactive level in response to control signal PMP_X being active or inactive, respectively. In addition, control logic 940 may drive signal Pump_Dn to an inactive or active level in response to control signal PMP_X being active or inactive, respectively.

Control logic 940 may respond to a signal CLMP_X depending upon how the charge pump is deployed. For example, if charge pump 900 drives a p-well to bias NMOS devices, in response to clamp signal CLMP_X being active, control logic 940 may drive signal Pump_Dn to an inactive level and signal Pump_Up to an active level. Conversely, if charge pump 900 drives an n-well to bias PMOS devices, in response to clamp signal CLMP_X being active, control logic 940 may drive signal Pump_Up to an inactive level and signal Pump_Dn to an active level.

In one embodiment, control logic 940 may interlock activation of signals Pump_Up and Pump_Dn. In particular, signal Pump_Up may be activated only after signal Pump_Dn is deactivated and vice versa.

Pump up circuit 942-0 may drive pump output 944 in a positive voltage direction in response to signal Pump_Up being active. In response to signal Pump-Up being inactive, pump up circuit 942-0 may present a high impedance with respect to pump output 944. In a similar fashion, pump down circuit 942-1 may drive pump output 944 in a negative voltage direction in response to signal Pump_Dn being active, and present a high impedance at pump output 944 when signal Pump_Dn is inactive.

In this way, a charge pump may provide unidirectional or bidirectional pumping of a substrate bias potential.

Figure 10:
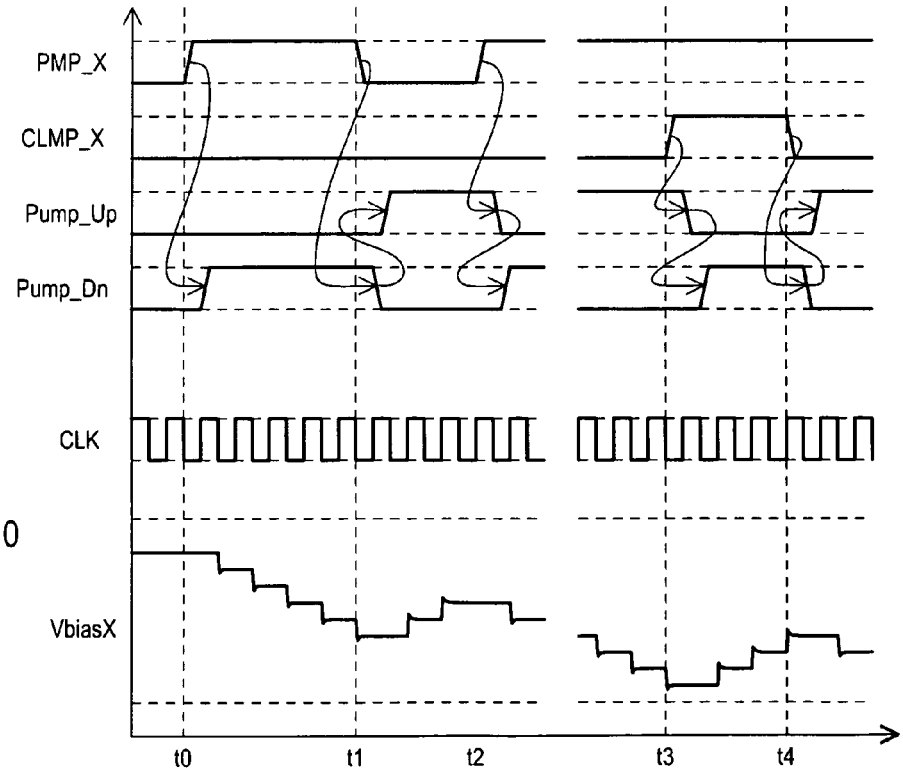
FIG. 10 is a timing diagram showing one example of a response for a charge pump like that of FIG. 9.

Referring now to FIG. 10, a timing diagram shows an operation of a charge pump like that shown in FIG. 9. FIG. 10 shows waveforms corresponding to signals PMP_X, CLMP_X, Pump_Up, Pump_Dn, and CLK. In addition, FIG. 10 shows a sample response for bias potential VbiasX. The example of FIG. 10 shows a response of a charge pump connected to a p-well containing NMOS devices.

Prior to time t0, signals PMP_X, CLMP_X, Pump_Up, and Pump_Dn may all be inactive (low in this example).

At about time t0, control signal PMP_X may transition to an active level. In response, signal Pump_Dn may be activated. This results in VbiasX being pumped in a negative voltage direction according to clock signal CLK.

At about time t1, control signal PMP_X may transition to an inactive level. In response, signal Pump_Dn may be deactivated, followed by the activation of signal Pump_Up. This results in VbiasX being pumped to a higher voltage according to clock signal CLK.

At about time t3, clamp signal CLMP_X transitions to an active level. As a result, active control signal PMP_X is overridden, and signal Pump_Dn is deactivated, followed by the activation of signal Pump_Up. This results in VbiasX being pumped to a higher voltage according to clock signal CLK.

At about time t4, clamp signal CLMP_X returns to an inactive level. As a result, active control signal PMP_X dictates the control of the charge pump. Because signal PMP_X is active, signal Pump_Up is deactivated, followed by the activation of signal Pump_Dn. This results in VbiasX being pumped to a lower voltage according to clock signal CLK.

In this way, a charge pump may respond to both a control signal and an overriding clamp signal.

Figure 11A:
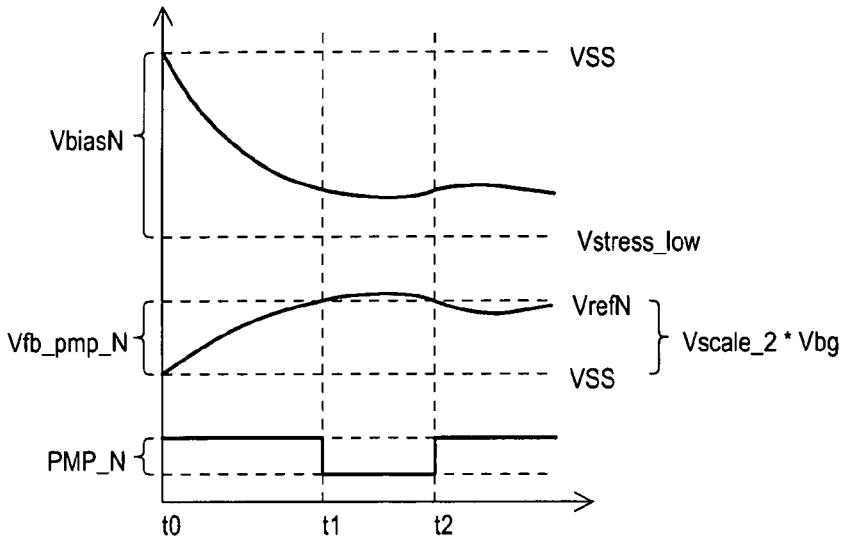
FIGS. 11A and 11B show examples of responses for a pump control circuit and clamp control circuit that may be included in embodiments.

Referring now to FIG. 11A, a timing diagram shows a first example of a response of a pump control circuit. FIG. 11A includes waveforms for a substrate bias voltage VbiasN, a feedback control voltage Vfb_pmp_N, and a corresponding control signal PMP_N. It is assumed that the operation of FIG. 11A drives a p-type substrate region with a substrate bias voltage VbiasN. In very particular arrangements, FIG. 11A may represent one example of a response for a circuit like shown as 102 in FIG. 1, 202 in FIG. 2, 302 in FIG. 3, 402-N in FIG. 4, or 502-N in FIG. 5.

Referring still to FIG. 11A, at time t0 control signal PMP_N may be active, driving bias voltage VbiasN in a negative direction. In response, by operation of a reference generator, a feedback control voltage (Vfb_pmp_N) may rise.

At about time t1, feedback control voltage (Vfb_pmp_N) may exceed a reference voltage VrefN. This results in the deactivation of control signal PMP_N. Consequently, bias potential VbiasN may cease falling.

At about time t2, feedback control voltage (Vfb_pmp_N) returns below reference voltage VrefN. This results in the activation of control signal PMP_N. Consequently, bias potential VbiasN begins falling in potential once again.

FIG. 11A also shows how a reference voltage VrefN may be scaled version of a temperature compensated voltage, which in the particular example shown, is a band gap voltage (Vbg) scaled by a factor of "Vscale_2".

Figure 11B:
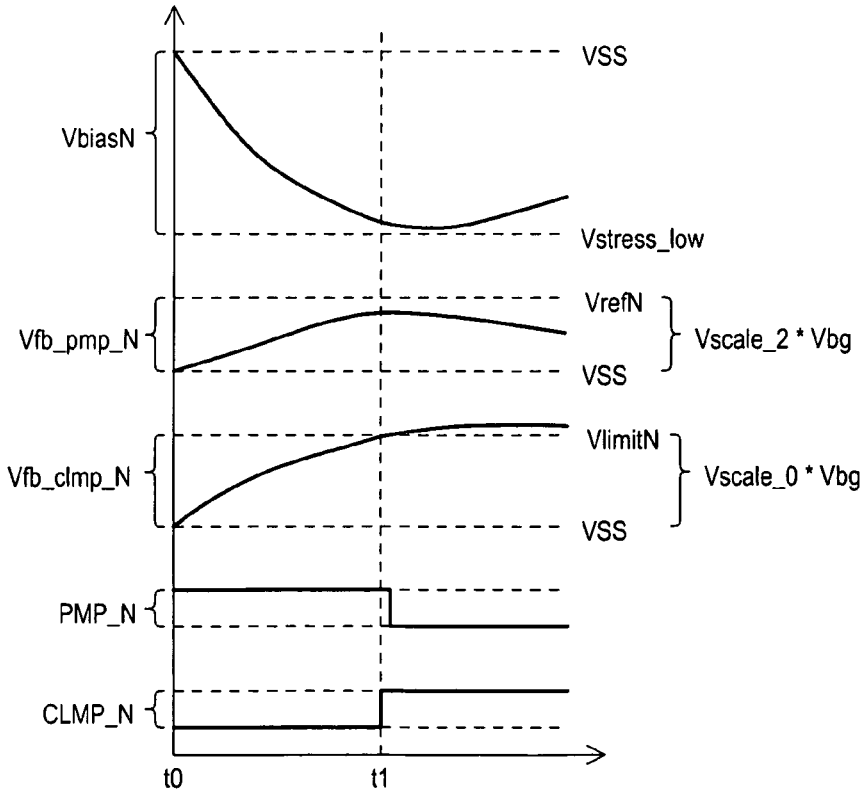

Referring now to FIG. 11B, a timing diagram shows an example of a clamping response of a clamp control circuit. FIG. 11B includes the same waveforms as FIG. 11A, but in addition, includes a feedback clamp voltage Vfb_clmp_N and a corresponding clamp signal CLMP_N. This example also assumes that the operation of FIG. 11B drives a p-type substrate region with a substrate bias voltage VbiasN. In very particular arrangements, FIG. 11B may represent one example of a clamping response for a clamp control circuit like shown as 104 in FIG. 1, 204 in FIG. 2, 304 in FIG. 3, 404-N in FIG. 4, or 504-N in FIG. 5.

Referring still to FIG. 11B, at time t0 control signal PMP_N may be active, driving bias voltage VbiasN in a negative direction. In response, by operation of a reference generator, a feedback control voltage (Vfb_pmp_N) may rise. Similarly, by operation of clamp scalar circuit (also not shown), a feedback clamp voltage (Vfb_clmp_N) may also rise.

At about time t1, before feedback control voltage (Vfb_pmp_N) exceeds reference voltage VrefN, feedback clamp voltage (Vfb_clmp_N) exceeds limit voltage Vlimit_N. This results in the activation of clamp signal CLMP_N. Consequently, bias potential VbiasN may cease falling.

FIG. 11B also shows how a reference voltage VlimitN may be scaled version of a temperature compensated voltage, which in the particular example shown, is also a band gap voltage (Vbg) scaled by a factor of "Vscale_0".

Figure 12A:
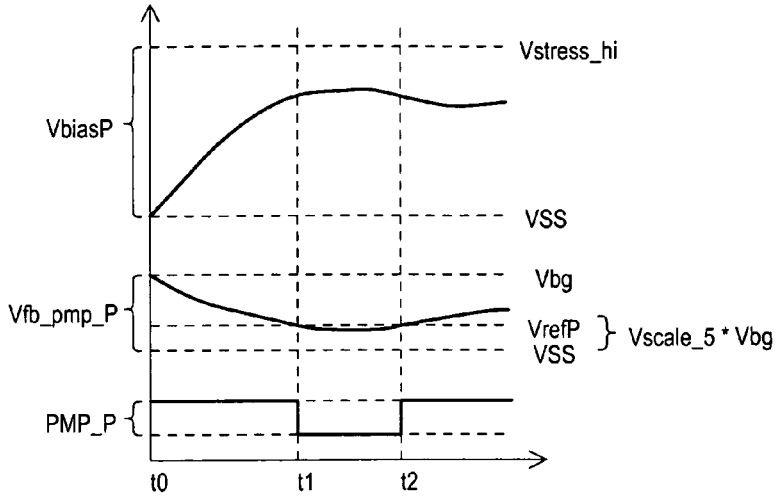
FIGS. 12A and 12B show further examples of responses for a pump control circuit and clamp control circuit that may be included in embodiments.
Figure 12B:
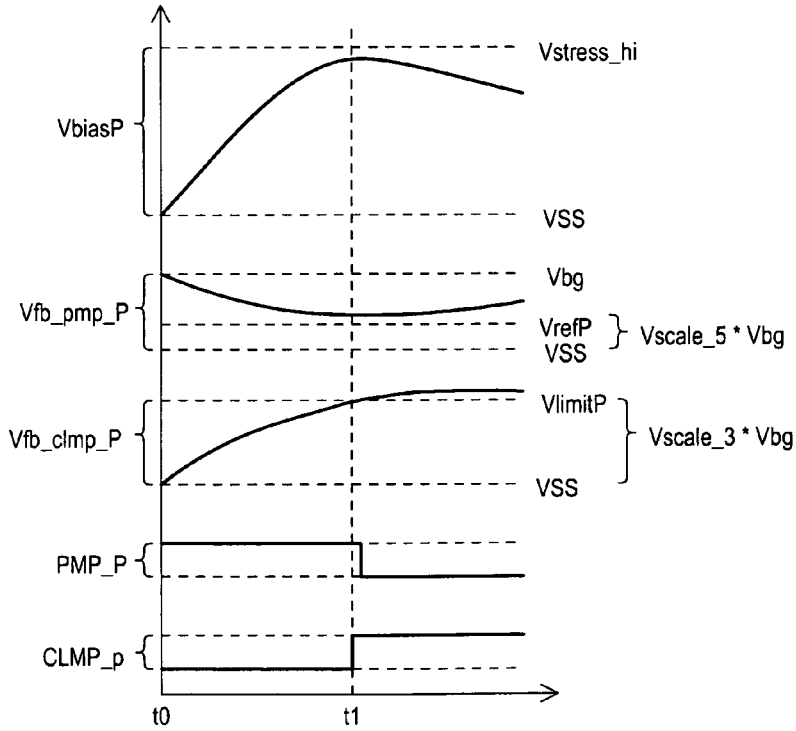

FIGS. 12A and 12B show the same essential operations as FIGS. 11A and 11B, but for circuits that control a bias potential for an n-type substrate region.

While the various examples of FIGS. 11A to 12B show circuit responses to single levels (VrefN/P, VlimitN/P), other embodiments may include some hysteresis in a response. One very particular example of such an arrangement is shown in FIG. 13.

Figure 13:
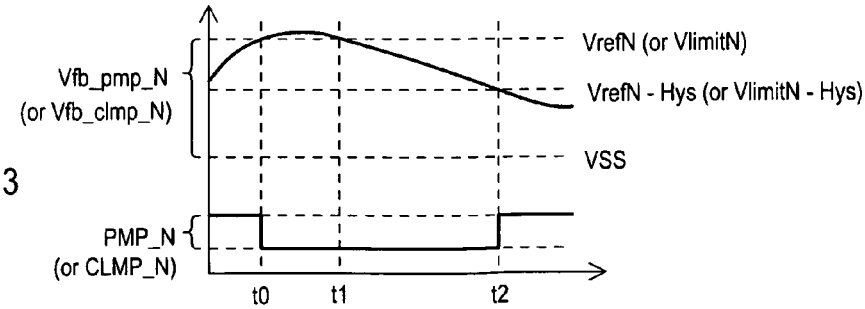
FIG. 13 is a timing diagram showing how hysteresis may be included in responses for a pump control circuit and/or a clamp control circuit of embodiments.

Referring to FIG. 13, a timing diagram shows a response including some hysteresis. FIG. 13 shows a feedback voltage, which may be a feedback control voltage (Vfb_pmp_N) or a feedback clamp voltage (Vfb_clmp_N), as well as corresponding signal, which may be a control signal PMP_N or clamp signal CLMP_N.

At about time t0, the voltage (Vfb_pmp_N or Vfb_clmp_N) exceeds its corresponding limit (VrefN or Vlimit_N) resulting in the signal (PMP_N or CLMP_N) being deactivated.

At about time t1, the voltage (Vfb_pmp_N or Vfb_clmp_N) returns below its corresponding limit (VrefN or Vlimit_N). However, due to hysteresis a resulting signal (PMP_N or CLMP_N) is not activated.

At about time t2, the voltage (Vfb_pmp_N or Vfb_clmp_N) falls below the corresponding limit (VrefN or Vlimit_N) beyond a hysteresis point. As a result, the signal (PMP_N or CLMP_N) is activated once again.

In this way, a pump control circuit and/or clamp control circuit may include hysteresis when generating a control signal and/or clamp signal.

In some embodiments, a rate at which a charge pump changes a bias potential may vary in response how far a substrate region is from a target potential. One particular example of such an arrangement is shown in FIG. 14.

Referring to FIG. 14, a pump clock control circuit is shown in block schematic diagram and designated by the general reference character 1400. A pump clock control circuit 1400 may receive a voltage difference value (VrefX−Vfb_pmp_X), and in response, generate a clock signal CLK that may vary correspondingly. In the particular embodiment shown, a pump clock control circuit 1400 may include an analog-to-digital converter (ADC) 1443 and a clock multiplier 1445. An ADC 1443 may receive the voltage difference (VrefX−Vfb_pmp_X) and convert such a value into a digital value CLKSEL A clock multiplier 1445 may receive a source clock signal CLK_SRC and output a clock signal CLK that may control a rate at which a charge pump drives a substrate portion. In response to value CLKSEL, a clock multiplier 1445 may multiply source clock CLK_SRC by a predetermined amount to generate clock signal CLK.

Of course FIG. 14 shows but one example of a pump clock control circuits. Other embodiments may include analog approaches, such a voltage controlled oscillator (VCO) that utilizes a voltage difference (difference between a present substrate voltage and a target voltage) to modify an output clock signal frequency. Still other embodiments may vary a clock duty cycle to control a strength at which charge pumps drive substrate portions.

In this way, a substrate bias circuit may increase a drive strength of charge pumps the further away a substrate portion is from a desired voltage level.

According to some embodiments, biasing of substrate regions with charge pumps may be bypassed, allowing substrate regions to be connected to a power supply voltage. Examples of such embodiments are shown in FIGS. 15 and 16.

Referring to FIG. 15, a bypass arrangement for p-wells is represented by a diagrammatic side cross sectional view, and designated by the general reference character 1500. Bypass arrangement 1500 may bias a p-well 1512 to either a charge pump generated bias potential VbiasN, or may shunt such a p-well 1512 to a low power supply reference (VSS). In the particular arrangement shown, a bias device 1546, which may be a NMOS device, may connect p-well 1512 to a bias potential VbiasN in response to a signal WELLBIAS. A bypass device 1548, which may also be an NMOS device, may connect p-well 1512 to lower power supply reference (VSS) in response to a signal BYPASS. Bias device 1546 may be formed in a bypass p-well 1550 that may itself be biased to bias potential VbiasN. Bypass device 1548 may be formed in a bypass p-well biased to supply reference (VSS).

When charge pumps are enabled, signal WELLBIAS may be active (high in this example), while signal BYPASS is inactive (low in this example), and bias device 1546 will connect p-well 1512 to bias potential VbiasN. When charge pumps are disabled resulting in bias potential VbiasN rising to VSS, signal WELLBIAS may be inactive, and signal BYPASS may be active. Bypass device 1548 may then connect p-well 1512 to VSS.

Referring to FIG. 16, a bypass arrangement for n-wells is represented by a diagrammatic side cross sectional view, and designated by the general reference character 1600. Bypass arrangement 1600 has a similar arrangement to that of FIG. 15.

When charge pumps are enabled, signal WELLBIASB may be active (low in this example), while signal BYPASSB is inactive (high in this example), and bias device 1646 will connect n-well 1612 to bias potential VbiasP. When charge pumps are disabled resulting in bias potential VbiasP falling to VDD, signal WELLBIAS may be inactive, and signal BYPASS may be active. Bypass device 1648 may then connect p-well 1612 to VDD.

While some embodiments have shown arrangements in which charge pump circuits may drive substrate portions of a bulk substrate, other embodiments may bias different types of substrate. One particular example of such an arrangement is shown in FIG. 17.

Referring to FIG. 17, an integrated circuit substrate 1710 is shown in a side cross sectional view. Substrate 1710 may include a semiconductor layer 1754 formed on a substrate insulating layer 1756. Semiconductor layer 1754 may include one or more p-type regions 1758 containing NMOS devices, as well as one or more n-type regions 1760 containing PMOS devices. P-type region 1758 may be biased to a bias potential VbiasN, while n-type region 1760 may be biased to a bias potential VbiasP. Bias potentials VbiasN and/or VbiasP may be generated according to any of the substrate bias circuit shown herein, or equivalents.

In one particular embodiment, a substrate 1710 may be a silicon-on-insulator (SOI) type substrate.

While embodiments above have shown arrangements in which pump control circuits and clamp control circuits utilize op amps to compare feedback voltages with reference/limit voltages, alternate embodiments may utilize other voltage comparator circuits.

It should be appreciated that in the foregoing description of exemplary embodiments, various features are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

It is also understood that the embodiments of the invention may be practiced in the absence of an element and/or step not specifically disclosed. That is, an inventive feature of the invention can be elimination of an element.

Accordingly, while the various aspects of the particular embodiments set forth herein have been described in detail, the present invention could be subject to various changes, substitutions, and alterations without departing from the spirit and scope of the invention.

What is claimed is:

1. A substrate biasing circuit, comprising:

a first pump control circuit that generates a first control signal in response to a first reference voltage and a voltage of a first substrate portion, and includes a first reference generator coupled between a temperature compensated voltage and a reference power supply voltage that varies the first reference voltage in response to the voltage of the first substrate portion and the temperature compensated voltage;

a first clamp circuit that generates a first clamp signal in response to a first limit voltage and the voltage of the first substrate portion, the first limit voltage being a scaled version of the temperature compensated voltage; and a first charge pump that pumps the first substrate portion in at least a first voltage direction in response to the first control signal, and is at least prevented from pumping in the first voltage direction in response to the first clamp signal.

2. The substrate biasing circuit of claim 1, wherein:

the first reference generator includes a first bias transistor having a body coupled to receive the voltage of the first substrate portion.

3. The substrate biasing circuit of claim 2, wherein:

the first reference generator further includes a first reference impedance coupled in series with the source-drain path of the first bias transistor between the temperature compensated voltage and the reference supply voltage.

4. The substrate biasing circuit of claim 1, wherein:

the first pump control circuit includes a first reference amplifier having a first input coupled to receive the first reference voltage and a second input coupled to the voltage of the first substrate portion; and the first clamp circuit includes a first clamp amplifier having a first input coupled to receive the first limit voltage and a second input coupled to the voltage of the first substrate portion.

5. The substrate biasing circuit of claim 1, wherein:

the first substrate portion is of p-type conductivity; and the first pump control circuit further includes a polarity inversion circuit that changes the polarity of the voltage of the first substrate portion before applying it to the first reference amplifier.

6. The substrate biasing of circuit 1, further including:

a band gap reference voltage circuit that generates the temperature compensated reference voltage.

7. The substrate biasing circuit of claim 1, further including:

a second pump control circuit that generates a second control signal in response to the first reference voltage and a voltage of a second substrate portion of a different conductivity type than the first substrate portion, the second pump control circuit including a second reference generator coupled between the temperature compensated voltage and the reference power supply voltage that varies the second reference voltage in response to the voltage of the second substrate portion and the temperature compensated voltage.

8. A substrate bias circuit, comprising:

a first clamp circuit that activates a first clamp signal in response to a comparison between a first limit voltage and a first substrate voltage;

a first control circuit that activates a first pump signal in response to a comparison between a first reference voltage and the first substrate voltage;

a second clamp circuit that activates a second clamp signal in response to a comparison between a second limit voltage and a second substrate voltage;

a first charge pump that is prevented from pumping a first substrate portion in a first voltage direction in response to the first clamp signal, the first charge pump pumping the first substrate portion in the first voltage direction in response to the first pump signal unless overridden by the first clamp signal; and a second charge pump that is prevented from pumping a second substrate portion in a second voltage direction in response to the second clamp signal; wherein the first and second limit voltages are generated from a temperature compensated voltage.

9. The substrate bias circuit of claim 8, wherein:

the first clamp circuit includes a first clamp amplifier having a first input coupled to receive the first limit voltage, and a feedback polarity inversion circuit that inverts a polarity of the first substrate voltage before applying it to a second input of the first clamp amplifier.

10. The substrate bias circuit of claim 8, wherein:

the second clamp circuit includes a second clamp amplifier having a first input coupled to receive the second limit voltage, and a feedback voltage scaling circuit that scales the second substrate voltage before applying it to a second input of the second clamp amplifier.

11. The substrate bias circuit of claim 8, wherein:

the first clamp circuit includes a first reference scaling circuit that scales a primary temperature compensated voltage to generate the first limit voltage, and a first clamp amplifier having a first input that receives the first limit voltage and a second input coupled to the first substrate voltage; and the second clamp circuit includes a second reference scaling circuit that scales the primary temperature compensated voltage to generate the second limit voltage, and a second clamp amplifier having a first input that receives the second limit voltage and a second input coupled to the second substrate voltage.

12. The substrate bias circuit of claim 8, wherein:

the first control circuit includes a first reference generator circuit having a reference transistor that draws a reference current and has a body comprising the first substrate portion, and a reference impedance through which the reference current flows to generate a substrate feedback voltage for comparison with the first reference voltage.

13. A method of biasing an integrated circuit substrate, comprising:

generating a first reference voltage from a primary temperature compensated voltage;

generating a first feedback voltage in response to at least the primary temperature compensated voltage and a first substrate portion voltage;

generating a first limit voltage from the primary temperature compensated voltage; and controlling the first substrate portion voltage in response to the first reference voltage, first feedback voltage and first limit voltage, including preventing a pumping of the first substrate portion in a first voltage direction in response to a comparison between the first limit voltage and the first substrate portion voltage.

14. The method of claim 13, wherein:

controlling the first substrate portion voltage includes pumping the first substrate portion in the first voltage direction in response to a comparison between the first reference voltage and the first feedback voltage.

15. The method of claim 14, further including:

preventing the pumping of the first substrate portion includes inverting a polarity of the first substrate portion voltage to generate a modified first substrate voltage, and comparing the modified first substrate voltage to a scaled version of the primary temperature compensated voltage.

16. The method of claim 13, wherein:

generating the first feedback voltage includes coupling a body of at least one feedback transistor to the first substrate portion voltage to generate a leakage current, and passing the leakage current through a reference impedance to generate the first feedback voltage.

17. The method of claim 13, further including:

generating a second reference voltage from the primary temperature compensated voltage;

generating a second feedback voltage in response to at least the primary temperature compensated voltage and a second substrate portion voltage;

generating a second limit voltage from the primary temperature compensated voltage; and controlling the second substrate portion voltage in response to the second reference voltage, second feedback voltage and second limit voltage.

18. A method of biasing an integrated circuit substrate, comprising:

generating a first reference voltage from a primary temperature compensated voltage for controlling activation of a first charge pump that controls a potential of a first substrate portion by at least pumping the first substrate portion in first and second voltage directions;

generating a first limit voltage from the primary temperature compensated voltage for limiting the potential of the first substrate portion;

generating a second reference voltage from the primary temperature compensated voltage for controlling activation of a second charge pump that controls a potential of a second substrate portion; and generating a second limit voltage from the primary temperature compensated voltage for limiting the potential of the second substrate portion.

19. The method of claim 18, wherein:

controlling activation of the first charge pump includes activating the first charge pump to drive the first substrate portion in a negative voltage direction, the first substrate portion comprising a plurality of p-doped regions, each including at least one n-channel insulated gate field effect transistor; and controlling activation of the second charge pump includes activating the second charge pump to drive the second substrate portion in a positive voltage direction, the second substrate portion comprising a plurality of n-doped regions, each including at least one p-channel insulated gate field effect transistor.

20. The method of claim 18, wherein:

limiting the potential of the first substrate portion includes preventing the first charge pump from driving the first substrate portion to a voltage lower than a first predetermined voltage, the first substrate portion comprising a plurality of p-doped regions, each including at least one n-channel insulated gate field effect transistor; and limiting the potential of the second substrate portion includes preventing the second charge pump from driving the second substrate portion to a voltage higher than a second predetermined voltage, the second substrate portion comprising a plurality of n-doped regions, each including at least one p-channel insulated gate field effect transistor.

21. The method of claim 18, wherein:

generating the first reference voltage includes biasing a first reference transistor between the primary temperature compensated voltage and a reference supply voltage, a body of the first reference transistor being formed in the first substrate portion; and generating the second reference voltage includes biasing a second reference transistor between the primary temperature compensated voltage and the reference supply voltage, a body of the second reference transistor being formed in the second substrate portion.

22. The method of claim 18, wherein:

controlling activation of the first charge pump includes comparing the first reference voltage to the voltage of the first substrate portion and pumping the first substrate portion in the first voltage direction in response to a first compare result, and pumping the first substrate portion in the second voltage direction in response to a second compare result.

* * * * *